US007526218B2

(12) United States Patent
Ahl et al.

(10) Patent No.: US 7,526,218 B2
(45) Date of Patent: Apr. 28, 2009

(54) METHOD FOR ADJUSTING TRANSFER CURRENT IN AN IMAGE TRANSFER MACHINE

(75) Inventors: David Kenneth Ahl, Rochester, NY (US); Michael N. Soures, Webster, NY (US); Robert Arnold Gross, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 12/144,390

(22) Filed: Jun. 23, 2008

(65) Prior Publication Data

US 2008/0260403 A1 Oct. 23, 2008

Related U.S. Application Data

(62) Division of application No. 11/280,005, filed on Nov. 16, 2005, now Pat. No. 7,391,982.

(51) Int. Cl.
*G03G 15/00* (2006.01)
*G03G 15/16* (2006.01)

(52) U.S. Cl. ..... 399/44; 399/66

(58) Field of Classification Search ..... 399/44, 399/45, 66, 297

See application file for complete search history.

(56) References Cited

U.S. PATENT DOCUMENTS 3,935,517 A 1/1976 O'Brien
4,077,709 A 3/1978 Borostyan et al.
5,585,908 A 12/1996 Rakov et al.
5,606,395 A 2/1997 Yang et al.
5,697,015 A 12/1997 Ream et al.
5,923,921 A 7/1999 OuYang et al.
5,983,044 A 11/1999 Kodama et al.
6,115,560 A 9/2000 Kuek et al.
6,223,004 B1 4/2001 Kodama
6,327,445 B1 12/2001 Honda et al.
6,571,000 B1 5/2003 Rasmussen et al.
6,763,201 B1 7/2004 Reijnders
6,806,972 B1 10/2004 Daddis et al.
6,904,255 B2 6/2005 Kera et al.
6,928,250 B1 8/2005 Adams et al.
7,391,982 B2 * 6/2008 Ahl et al. ..... 399/44

* cited by examiner

*Primary Examiner*—Robert Beatty
(74) *Attorney, Agent, or Firm*—Maginot, Moore & Beck LLP

(57) ABSTRACT

In a printing machine having at least one transfer device driven in response to an electrical signal and operable to transfer a medium onto a sheet, a method controls the magnitude of the electrical signal driving the transfer device. The method includes assigning a magnitude of the electrical signal for driving the transfer device to each of at least two transfer stress levels, evaluating only operating parameters of the printing machine that have a pre-determined priority value relative to a corresponding pre-determined threshold value, selecting one of the at least two transfer stress levels based on the evaluation of the at least one operating parameter, and applying the magnitude of the electrical signal corresponding to the selected stress level to the electrically-driven transfer device.

20 Claims, 1 Drawing Sheet

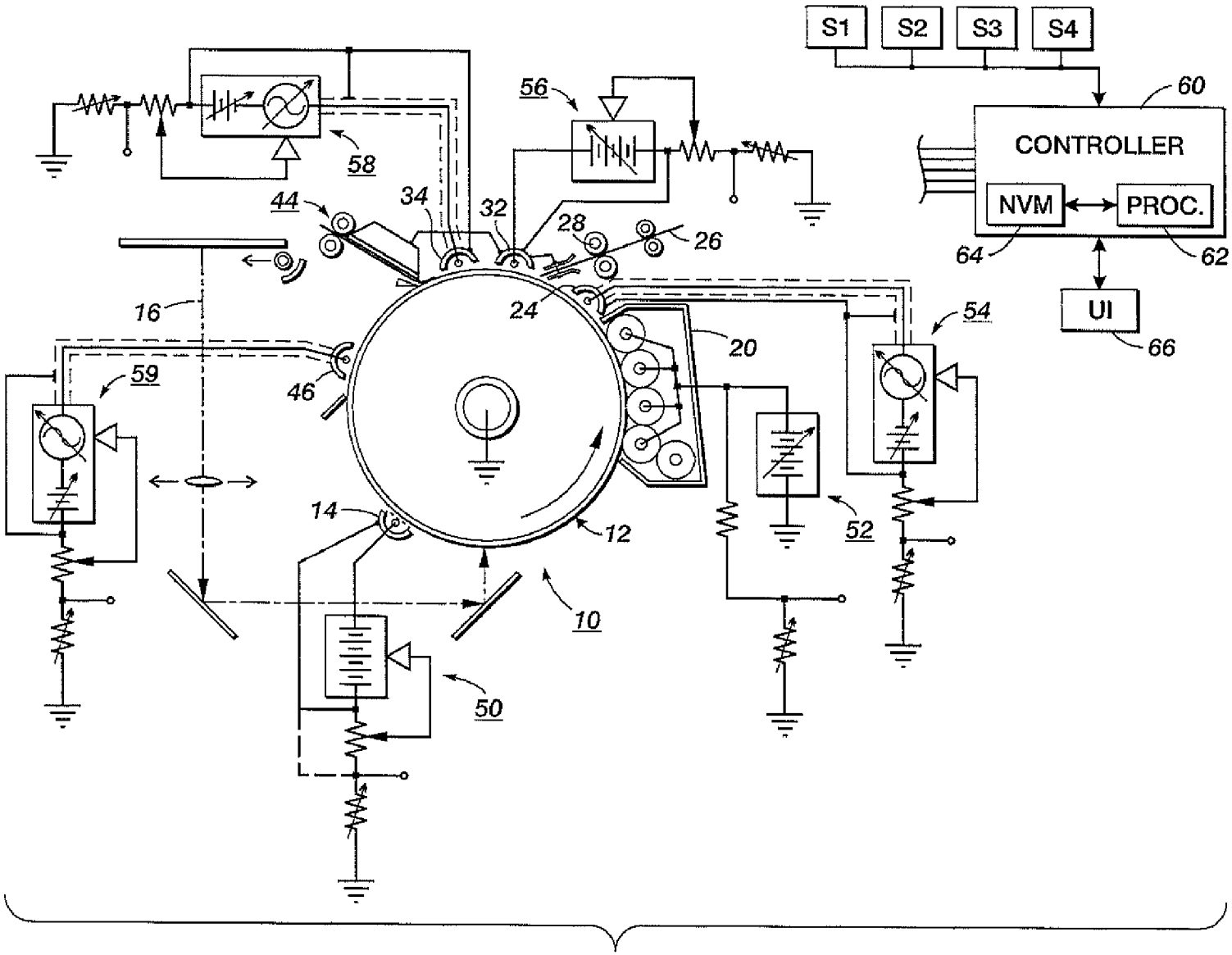
CONTROLLER
PROC.
NVM
UI
S1
S2
S3
S4
60
62
64
66
10
12
14
16
20
24
26
28
32
34
44
46
50
52
54
56
58
59

METHOD FOR ADJUSTING TRANSFER CURRENT IN AN IMAGE TRANSFER MACHINE

TECHNICAL FIELD

The presently disclosed embodiments are directed to an image transfer machine, and particularly to an electrostatographic machine that utilizes current-driven devices to generate a charge on the surface of a photoreceptor and a transfer sheet.

BACKGROUND

Image transfer machines are used in printers, copy machines, facsimile machines, multi-function machines and the like. These machines utilize electrostatographic techniques to transfer an image from a toner-bearing photoreceptor surface to a transfer sheet passing over that surface. This transfer is most commonly achieved by electrostatic forces created by D.C. applied to or adjacent the back face of the transfer sheet while the front side of the sheet faces or contacts the photoreceptor surface. The transfer field is sufficient to overcome the forces holding the toner on the photoreceptor surface and to attract the toner onto the front face of the transfer sheet. These transfer fields are typically generated in one of two ways: by corona emission from a transfer corona generator; or by an electrically biased transfer roller or belt rolling along the back of the transfer sheet and holding it against the photoreceptor. The present disclosure relates to the electrical control of such transfer systems.

It is known that several factors contribute to affect the quality of the image transferred from the photoreceptor to the transfer sheet. Some of the factors are related to the components of the image transfer machine, such as the amount of useful life remaining in the component that generates the transfer field. Other factors are related to the environment in which the machine is being operated, namely, altitude, relative humidity and internal machine temperatures.

Still other factors are a function of the transfer sheet itself, such as paper weight or resistivity. Certain defects, known as white spots, arise when the toner particles are inadequately transferred from the photoreceptor surface to the face of the transfer sheet. White spot defects are especially sensitive to many of the above factors, especially where a high resistivity paper is being used.

SUMMARY OF THE DISCLOSURE

A printing machine has at least one transfer device driven in response to an electrical signal and operable to transfer a medium onto a sheet, such as a current-driven corotron. A method controls the magnitude of the electrical signal driving the transfer device. The method includes assigning a magnitude of the electrical signal for driving the transfer device to each of at least two transfer stress levels, evaluating only operating parameters of the printing machine that have a pre-determined priority value relative to a corresponding pre-determined threshold value, selecting one of the at least two transfer stress levels based on the evaluation of the at least one operating parameter, and applying the magnitude of the electrical signal corresponding to the selected stress level to the electrically-driven transfer device.

The at least one operating parameter may include environmental parameters, such as altitude and relative humidity, or parameters of the sheet, such as paper weight. The at least one operating parameter may also include machine parameters, such as corotron life. Any combination or all of these and other parameters and corresponding pre-determined threshold values may be used.

The method may further comprise assigning a magnitude of the electrical signal is assigned to each of a high, a medium and a low stress condition. The corresponding pre-determined threshold values then include a threshold value corresponding to a change in stress condition from low to medium, and a threshold value corresponding to a change in stress condition from medium to high. A change in one of the evaluated operating parameters that exceeds one of the threshold values results in a corresponding change in the transfer stress condition.

The operating parameters may also be assigned different priorities in relation to the anticipated effect of the parameter on the transfer stress condition. Thus, at least a high priority or a low priority may be assigned to each of the plurality of operating parameters. The selection of one of the stress conditions may be based on the evaluation of only those operating parameters that do not have a low priority. A medium priority may also be assigned to certain operating parameters, in which case, the selection of one of the stress conditions is based either on the evaluation of any one of the operating parameters that have a high priority or on the evaluation of more than one of the operating parameters that have a medium priority.

DESCRIPTION OF THE FIGURE

The FIGURE is a schematic representation of an exemplary image transfer machine adaptable for use with the system and method of the present disclosure.

DESCRIPTION OF THE EMBODIMENTS

An exemplary image transfer machine 10 is depicted in the FIGURE that may be adapted for operation with the system and method of the present disclosure. The machine 10 includes a photoconductive imaging surface 12 that is initially uniformly charged by a charging scorotron 14. A latent image is formed on the imaging surface 12 by optically exposing the charged surface to an image obtained by a scanning system 16. The scanning system selectively discharges the surface according to the image pattern. The electrostatic latent image is developed at a developer station 20 in which one or more rotating magnetic developer rollers apply toner particles to the photoconductive imaging surface 12.

The imaging surface is next subjected to corona emissions from a pre-transfer corona generator 24. The developed and pre-treated toner image is conveyed to a transfer station 32 where the surface is overlaid with a transfer sheet 26 provided by feed means 28 from a sheet supply. The transfer station 32 includes a transfer corona generator to effect image transfer of toner particles from the imaging surface 12 to the front face of the sheet 26.

To assist in stripping the sheet 26 form the imaging surface, a detack corona generator 34 may be provided to apply another charge to the sheet sufficient to disassociate it from the imaging surface. The sheet is then fed to fusing station 44 that fuses the transferred toner image onto the front face of the sheet.

In the illustrated embodiment, the imaging surface may be on a rotating drum, as depicted in the FIGURE, or on a continuous belt. The imaging surface is conveyed from station to station at a rate of speed commensurate with the ability of the machine 10 to transfer an image from the scanning system 16, to the photoconductive surface 12, to the surface of the sheet 26.

The machine 10 relies upon electrostatic forces to attract toner particles to either the imaging surface 12 or the transfer sheet 26. Thus, the transfer media are subjected to electrostatic force fields or coronas from the various generators 14, 24, 32, 34, and 46. Depending upon the nature of the generator, the generator is powered by a variable DC power supply, such as the power supplies 54, 58 and 59, or a variable AC supply with a DC offset, such as power supplies 54 and 58. The transfer charges applied to the photoconductor surface 12 and the transfer sheet 26 are a function of the electrostatic fields produced by the generators, which are in turn functions of the voltage and/or current produced by the variable power supplies.

In many image transfer machines, the voltage and/or current generated by the power supplies is monitored and continuously adjusted to maintain a nominal set point for the power supply. One such system is disclosed in U.S. Pat. No. 6,928,250 (the '250 patent), assigned to the assignee of the present application, the disclosure of which is incorporated herein by reference. In the '250 patent, the wire voltage of a transfer corona generator is adjusted in response to dynamic conditions within the machine. For instance, the system in the '250 patent includes a controller, such as the controller 60 in the FIGURE, that refers to target values for the power supplies and compares those targets to values obtained by periodically polling the power supplies. The target values may be stored in a non-volatile memory (NVM) 64 associated with the controller. The controller includes a processor 62 that implements stored algorithms that dictate how the wire voltage for a particular corona generator is adjusted. The processor 62 also controls other functions and components of the machine 10, some of which are based on target values stored in the NVM 64.

It is also known that the corona transfer process is responsive to dynamic conditions of media movement, altitude, changes from one media to another, sheet velocity through the transfer stations, environmental conditions within the machine (i.e. humidity and temperatures), component life/wear and other conditions. Media characteristics, such as thickness and dielectric constant, also affect the magnitude and dispersion of the transfer charge on the transfer sheet. While systems such as the system disclosed in the '250 patent provide real-time monitoring and adjustment of the corona generating devices, it is desirable for the system to permit off-line adjustments to address print quality issues over the long haul. More particularly, the present disclosure contemplates adjustment of target or nominal values stored in NVM that are used in the algorithms that set the operating conditions of the power supplies feeding the transfer charge devices.

In accordance with the present system and method, various environmental, machine component and transfer sheet attributes are identified as contributing to the "stress" condition of the image transfer. High stress conditions are those conditions that are likely to cause image defects or deterioration of image quality, such as white spots. White spot print defects are typically caused by high resistivity transfer sheets, low relative humidity, high altitude and drying caused by high temperature and air flow through the machine. As the stress condition moves from high to medium to low stress, the likelihood of image quality problems decreases. According to the present system, three stress levels (high, medium and low) are contemplated, although finer levels may be implemented.

The machine 10 of the FIGURE includes a controller 60 that incorporates a processor 62 that is capable of running various algorithms that control the operation of the components of the machine. A user interface (UI) 66 allows a machine operator to enter data related to the copy/print job being executed. The UI 66 may also be used by a technician in diagnosing system performance. In accordance with this system, the technician may also use the UI 66 to make changes to the NVMs to address changes in stress conditions.

For the purposes of the present disclosure, the focus is on adjustments to the transfer current driving either the pre-transfer charge device 24 or the transfer charge device 32 to correct image defects or image quality problems. In a specific embodiment involving simplex mode copying (single pass), the transfer current for the pre-transfer charge device 24 under high and medium stress conditions may be nominally 84 μa, increasing to 88 μa for low stress conditions. The disclosed system also provides nominal current values for duplex copying that are lower than for the simplex mode. Thus, in the embodiment, the transfer current is set at 80 μa for high stress, 84 μa for medium stress, and increasing to 88 μa for low stress conditions. These nominal transfer current values may be stored in NVM when the machine 10, or more particularly its controller 60, is completed at the OEM.

As indicated above, the system is based on three stress levels—high, medium and low. A high stress transfer exists when a particular stress condition or operating parameter exceeds a threshold value, or alternatively when a combination of stress conditions exceeds a pre-determined threshold. Likewise, if the stress conditions fall within a high threshold and a medium threshold value, a medium stress transfer exists. If no threshold is exceeded by any stress condition, then a low stress transfer is possible. Some of the stress conditions may be based on machine operator inputs, such as paper weight. Other stress conditions are maintained by the controller 60 or processor 62, such as the age of the transfer charge devices. Still other stress conditions are sensed, such as relative humidity and temperature within the machine, as well as the altitude at which the machine is operated. These sensed conditions may thus require the addition of a number of sensors S1-S4 that communicate with the controller 60 to provide environmental condition data when a print/copy job is being run.

Threshold values for various stress conditions may be factory-installed in the NVM of the controller. Thus, in one embodiment, these stress conditions may include altitude (feet), paper weight (grams/sq. meter), relative humidity (%) and transfer corotron age (number of cycles). Mid-range and high thresholds may be provided for each stress condition. In one embodiment, for instance, the following values are maintained in NVM: altitude mid-range threshold—3000 ft; altitude high threshold—5000 ft.; paper weight mid-range threshold—90 gsm; paper weight high threshold—180 gsm; relative humidity mid-range threshold—35 percent; relative humidity high threshold—55 percent; corotron age mid-range threshold—300,000 cycles; and corotron age high threshold—600,000 cycles. In accordance with this embodiment, when the measured condition exceeds the mid-range threshold the transfer stress increases from low stress to medium stress. Similarly, when a stress condition exceeds the high threshold the transfer stress increases from medium stress to high stress.

In a specific example, if the machine 10 is being operated at less than 3000 ft altitude, neither threshold is exceeded so a low stress transfer exists. In this case, the low stress transfer current of 88 μa is applied to the pre-transfer charge device 24. If the machine is being used at 4000 ft, the mid-range threshold is exceeded but not the high threshold altitude (5000 ft), so a medium stress transfer exists, corresponding to a transfer current of 84 μa.

It can be appreciated that for a particular machine executing a particular copy job, more than one stress condition may be involved. For instance, an older machine may be used in a high altitude, high humidity environment to transfer images onto a high weight transfer sheet. The presently disclosed system and method assigns a priority to the various stress conditions—a priority of 0 has no effect on the cumulative stress of the transfer; priority 1 is a mid-level priority; priority 2 is a high priority. Priority values for each stress condition are also stored in NVM. In the above example, altitude, humidity and corotron age can have a high priority value of 2, while paper weight has a priority value of 1.

For high priority stress conditions, increase of the condition value of any one of the stress conditions above the mid range threshold stored in NVM automatically results in a high stress transfer so that the high stress transfer current is applied. On the other hand, in accordance with one feature, where the stress conditions have a priority of 1, more than one stress condition threshold must be exceeded before a high stress transfer is identified. For instance, if all four conditions noted above were assigned a priority of 1, more than one of these stress conditions must exceed the mid range threshold in order for a high stress transfer condition to be identified (resulting in a reduction of the transfer current). In other words, for priority one conditions, the altitude must exceed the mid range threshold of 5000 ft, the paper weight must exceed the mid range threshold of 180 gsm, and the relative humidity must exceed the mid range threshold of 55 percent, before a high stress transfer will be determined by the machine controller.

It should be appreciated that the present system and method provides the ability to tailor the stored NVM values for any image transfer machine based on machine and customer specifications. The present disclosure contemplates that a technician or installer may access the NVMs by accessing the controller in a known manner, and changing certain NVMs from the factory installed values. Thus, the thresholds for the stress conditions may be altered as well as the priority values assigned to those conditions. The same algorithm can be used to determine or adjust the nominal transfer current for each print/copy job.

A further feature is that the NVMs may be adjusted depending upon the needs for a particular application, or to correct print defects or image quality problems. The NVMs to be modified may be incorporated into a table of values corresponding to a particular machine, customer and application. The table of modified values may then be fed to the controller where the corresponding NVM values are changed. Alternatively, each pertinent NVM may be accessed and changed by a technician through the controller.

For example, for certain applications in high altitude environments (like Denver, Colo.), a different transfer current protocol is preferable. Thus, one specific protocol may set the high and low stress transfer current at 84 μa while the medium stress current is 70 μa for simplex operation. For duplex, the second side transfer current in this specific protocol may be 80 μa for the high and medium, increasing to 84 μa for low stress conditions. Modifications to the stress condition NVMs may also be appropriate for this high altitude environment. Thus, in this specific protocol, the paper weight high range threshold is changed from 90 gsm to 120 gsm, while the mid range threshold is changed from 180 to 300 gsm. The relative humidity high range is changed from 35% to 1% and the mid range threshold from 55% to 35%. Other environment-specific operating conditions for a particular image transfer machine may require its own set of different NVMs.

The NVMs may also be adjusted during test or set-up runs of a machine by a technician. For instance, if a machine is encountering white spot defects, certain pre-determined adjustments may be made to some NVMs to correct the defect. Thus, pre-determined changes may be made to one or more of the transfer current NVMs. A test run will verify whether the changes solved the problem, and if not that another pre-determined change may be made. For instance, one correction for white spot defects in duplex copying may be to reduce the high stress transfer current from 80 μa to 75 μa. This pre-determined modification may be based on empirical data that shows that such a reduction in transfer current eliminates the white spot problem without sacrificing the image transfer characteristics of the machine. If the first pre-determined adjustment does not correct the defect, the next change may be to successively reduce the transfer current in 2 μa increments until the white spots are eliminated.

It is understood that this adjustment process may be applied to NVMs that control the other operating parameters in order to correct other image quality or defect problems. In an image transfer machine, such as the machine 10, the current being supplied to the detack corotron will be a function of the transfer current supplied to the transfer corotron. In a typical machine, the detack current is about 30% of the transfer current. Adjustments to the detack function may be required to correct a problem in stripping the transfer sheet from the photoreceptor surface 12. Thus, the NVMs that control detack performance may be adjusted independent of the default relationship between detack and transfer forces.

It will be appreciated that various of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

What is claimed is:

1. In a printing machine having at least one transfer device driven in response to an electrical signal and operable to transfer a medium onto a sheet, a method for controlling the magnitude of the electrical signal driving the transfer device, comprising:

assigning a magnitude of the electrical signal for driving the transfer device to each of at least two transfer stress levels;

evaluating only operating parameters of the printing machine that have a pre-determined priority value relative to a corresponding pre-determined threshold value;

selecting one of the at least two transfer stress levels based on the evaluation of the at least one operating parameter; and applying the magnitude of the electrical signal corresponding to the selected stress level to the electrically-driven transfer device.

2. The method of claim 1, wherein the operating parameters of the printing machine include an environmental parameter.

3. The method of claim 2, wherein the environmental parameter is selected from the group including altitude and relative humidity.

4. The method of claim 1, wherein the operating parameters of the printing machine include at least one parameter of the sheet.

5. The method of claim 4, wherein the at least one parameter of the sheet includes paper weight.

6. The method of claim 1, wherein the operating parameters of the printing machine include a number of cycles of operation of the transfer device.

7. The method of claim 1, wherein the at least one operating parameter is selected from the group including altitude, relative humidity, paper weight, and a number of cycles of operation of the transfer device.

8. The method of claim 1, in which the printing machine is capable of simplex and duplex transfer, and the magnitude of the electrical signal assigned to each of the at least two transfer stress levels for a simplex transfer are greater than the magnitudes of the electrical signals corresponding to a duplex transfer.

9. The method of claim 1, wherein:

a magnitude of the electrical signal is assigned to a high, a medium and a low stress level; and the corresponding pre-determined threshold value includes a threshold value corresponding to a change in stress level from low to medium, and a threshold value corresponding to a change in stress level from medium to high.

10. The method of claim 9, further comprising:

assigning a high priority or a low priority as the pre-determined priority value to the operating parameters of the printing machine; and selecting one of the stress levels based on the evaluation of only those operating parameters that do not have the low priority assigned to the pre-determined priority value.

11. The method of claim 10, further comprising:

assigning a high priority, a medium priority, or a low priority as the pre-determined priority value to the operating parameters of the printing machine; and selecting one of the stress levels based the evaluation of the operating parameters that have a pre-determined priority value that is either a high priority or a medium priority.

12. A method for controlling the magnitude of an electrical signal driving a transfer device in a printing machine that is operable to transfer a medium onto a sheet, a method for, comprising:

assigning a magnitude to the electrical signal that drives the transfer device, the assigned magnitude being one of a high, a medium, and a low transfer stress levels;

comparing a pre-determined priority value for each of a plurality of operating parameters of the printing machine to a corresponding pre-determined threshold value corresponding to at least one of a change in stress level from low to medium, and a change in stress level from medium to high.

evaluating only the operating parameters of the printing machine having a pre-determined priority value that equals or exceeds the corresponding pre-determined threshold value;

selecting one of the at least two transfer stress levels for at least one of the evaluated operating parameters; and applying the assigned magnitude of the electrical signal to the transfer device, the assigned magnitude corresponding to the selected stress level.

13. The method of claim 12, wherein the operating parameters of the printing machine include an environmental parameter.

14. The method of claim 13, wherein the environmental parameter is selected from the group including altitude and relative humidity.

15. The method of claim 12, wherein the operating parameters of the printing machine include at least one parameter of the sheet.

16. The method of claim 15, wherein the at least one parameter of the sheet includes paper weight.

17. The method of claim 12, wherein the operating parameters of the printing machine include a number of cycles of operation of the transfer device.

18. The method of claim 12, wherein the operating parameters are selected from the group including altitude, relative humidity, paper weight, and a number of cycles of operation of the transfer device.

19. The method of claim 12, wherein the printing machine is capable of simplex and duplex transfer, and the magnitude of the electrical signal assigned to each transfer stress level for a simplex transfer is greater than the magnitude of the electrical signal assigned to each transfer stress level for a duplex transfer.

20. The method of claim 12, further comprising:

assigning a high priority or a low priority as the pre-determined priority value to the operating parameters of the printing machine; and selecting one of the stress levels based on the evaluation of only those operating parameters that have the high priority assigned to the pre-determined priority value.

* * * * *